United States Patent [19]

Bavelloni

[11] Patent Number: 4,890,423

[45] Date of Patent: Jan. 2, 1990

[54] SUPPORTING HEAD PARTICULARLY FOR MACHINING PLATES OF GLASS, MARBLE OR THE LIKE OF ANY SIZE

[75] Inventor: Franco Bavelloni, Appiano Gentile, Italy

[73] Assignee: Z. Bavelloni S.P.A., Bregnano, Italy

[21] Appl. No.: 232,812

[22] Filed: Aug. 15, 1988

[30] Foreign Application Priority Data

Aug. 27, 1987 [IT] Italy ..... 21735 A/87
Jan. 12, 1988 [IT] Italy ..... 19054 A/88

[51] Int. Cl.[4] ..... B24B 5/02; B24B 47/12; B23B 19/00

[52] U.S. Cl. ..... 51/235; 51/237 R; 51/283 E; 74/421 R; 82/142; 82/165; 414/783

[58] Field of Search ..... 51/235, 237 R, 283 E; 82/28 R, 40 R; 414/783; 74/421 R, 421 A

[56] References Cited

U.S. PATENT DOCUMENTS 622,458 4/1899 Fondu ..... 51/235
1,836,225 12/1931 Christensen ..... 74/421 R
2,688,214 9/1954 Ogle et al. ..... 51/235
3,930,343 1/1976 Welsch et al. ..... 51/237 R
4,051,635 10/1977 Ohrn ..... 51/237 R
4,426,811 1/1984 Eckarot et al. ..... 51/283 E
4,667,443 5/1987 Sakurai et al. ..... 51/283 E
4,756,124 7/1988 Rossi et al. ..... 51/283 E
4,769,954 9/1988 Hatas et al. ..... 51/165.71

FOREIGN PATENT DOCUMENTS 2011289 7/1979 United Kingdom ..... 51/283 E

*Primary Examiner*—William Terrell
*Attorney, Agent, or Firm*—Guido Modiano; Albert Josif

[57] ABSTRACT

A supporting head for an apparatus for machining plates of glass, marble and the like, including a main head supporting an auxiliary head; the main head is adapted to support large plates, the auxiliary head is adapted to support small plates. The main head has a main shaft connected to an auxiliary shaft of the auxiliary head by means of gears. The gears and main head may be selectively locked and released to allow for a rotation of the main head or a rotation of just the auxiliary head.

4 Claims, 3 Drawing Sheets

SUPPORTING HEAD PARTICULARLY FOR MACHINING PLATES OF GLASS, MARBLE OR THE LIKE OF ANY SIZE

BACKGROUND OF THE INVENTION

The present invention relates to a supporting head particularly for machining plates of glass, marble or the like of any size.

The machining of the edges of glass plates is currently performed on machines which comprise at least one supporting head wich retains the glass plate to be machined in position by means of suckers or the like.

Known heads currently have relatively large dimensions, with a significant circumferential bulk which prevents continuous machining along the entire perimeter of small-size glass plates such as for example those having a diameter of a few centimeters, since there would be interference between the supporting head of the plate and the tool-holder head which must machine the plate.

For these reasons, currently, small-size glass plates necessarily have to be machined along their edges with purely manual processes, also because the provision of a supporting head specifically for supporting small-size plates would lead to a scarcely versatile machine incapable of being used for larger-size plates, as presently occurs.

To obviate these disadvantages, a supporting head for glass plates has been provided which has a main head with a main shaft, which is caused to rotate about its own axis by a motor, and an auxiliary head operatively connected to the main head.

The auxiliary head has an auxiliary shaft, caused to rotate by means of gears by the main shaft and having an axis parallel thereto and spaced therefrom.

Supporting plates for the glass plate to be machined are also associable with the main and auxiliary heads.

The above solution, though it obviates the disadvantages of the initially mentioned heads, has the problem of requiring, whenever necessary, the removal of the supporting plate of the main head to allow the positioning of a supporting plate having adequate dimensions on the auxiliary head and vice versa, since it is not possible to keep, due to bulk and functional reasons, the two supporting plates mounted respectively on both the main and the auxiliary head.

SUMMARY OF THE INVENTION

The aim proposed by the present invention is to eliminate the disadvantages described above by providing a supporting head particularly for machining plates of glass, marble or the like of any size, which allows its use indifferently for large-size plates and for small-size plates, without performing any modification thereof.

Within this aim, a particular object of the invention is to provide a supporting head particularly for machining plates of glass, marble or the like of any size which is extremely versatile and flexible in use.

Still another object of the present invention is to provide a supporting head particularly for machining plates of glass, marble or the like of any size which can be used almost instantaneously with plates of any size, whether large or small and/or vice versa.

This aim and these objects are achieved by a supporting head particularly for machining plates of glass, marble or the like of any size, comprising a frame supporting a main head, having a main shaft rotating about its own axis, and an auxiliary head having an auxiliary shaft which is entrained in rotation by said main shaft by means of a first gear which meshes with a transmission gear which in turn meshes with a second gear keyed on said auxiliary shaft, characterized in that it comprises a plate associated with said main shaft and supporting said auxiliary shaft, said plate comprising locking means, selectively rigidly associable with said supporting frame or with said first gear respectively for the rotation of said auxiliary shaft about its own axis or for rotation of said auxiliary shaft together with said plate about said main shaft.

BRIEF DESCRIPTION OF THE DRAWINGS

Further characteristics and advantages of the invention will become apparent from the description of a preferred but not exclusive embodiment of the supporting head particularly for machining plates of glass, marble or the like of any size according to the invention, illustrated only by way of non-limitative example in the accompanying drawings, wherein.

DESCRIPTION OF THE PREFERRED EMBODIMENTS

Figure 1:
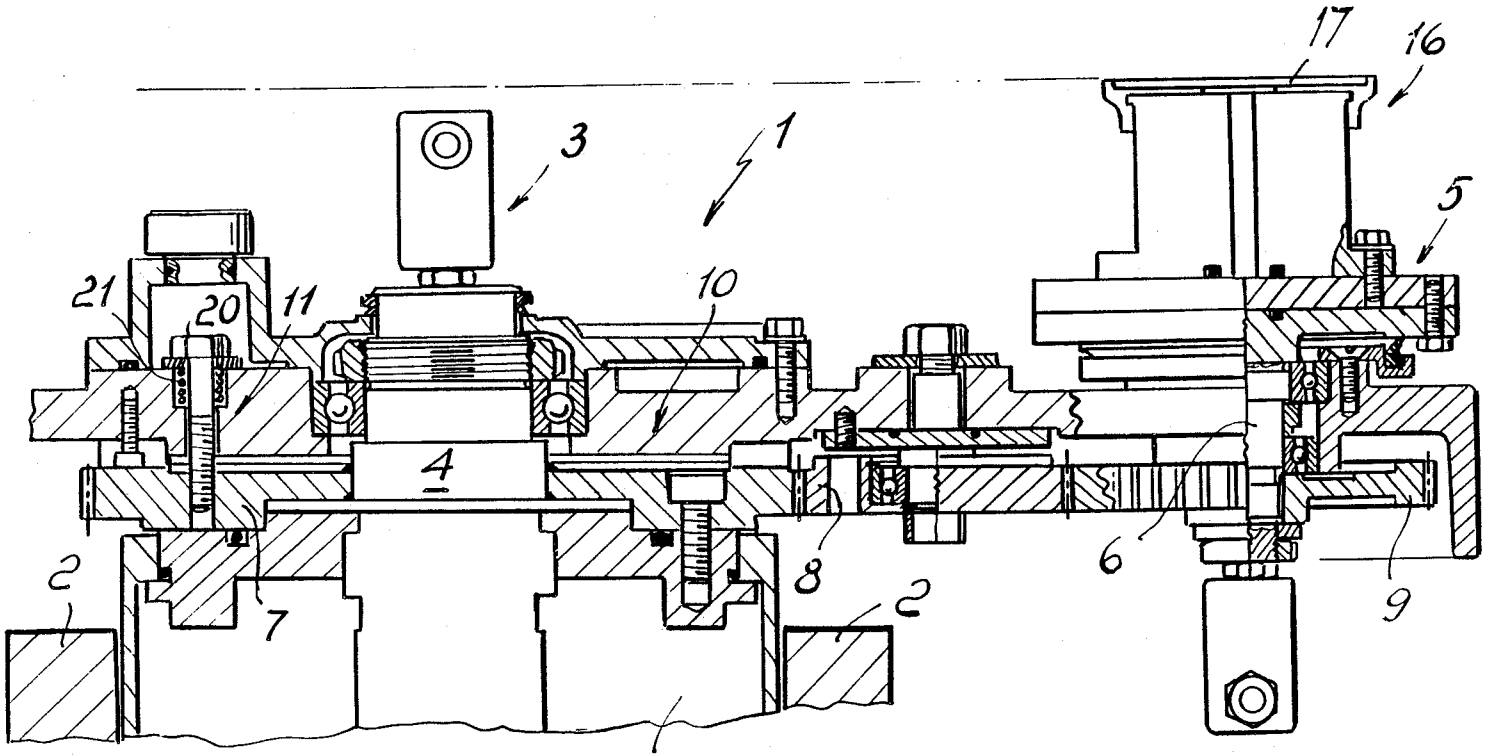
FIG. 1 is a sectional lateral elevation view of the supporting head according to the invention.
Figure 2:
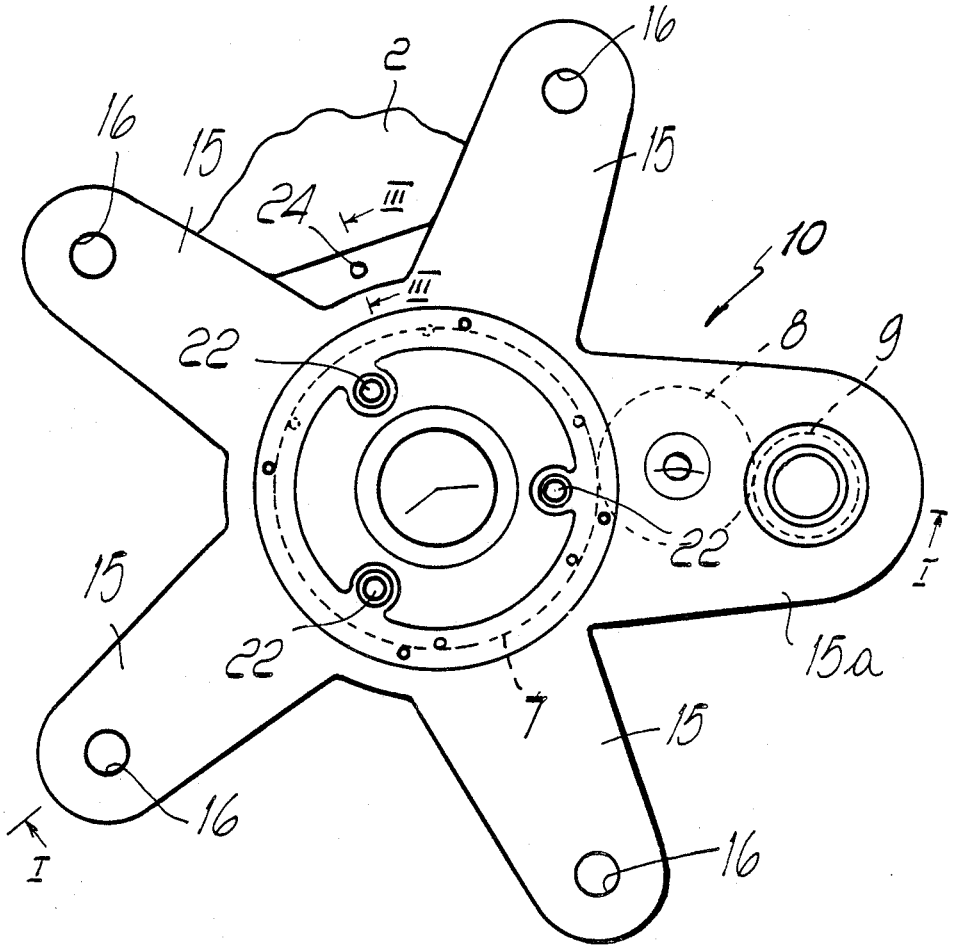
FIG. 2 is a reduced top plan view of the plate according to the invention, indicating, for the sake of greater clarity, the ideal line I—I for the execution of the sectional view illustrated in FIG. 1.
Figure 3:
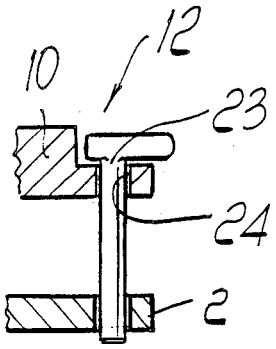
FIG. 3 is a schematic sectional view of a portion of the supporting head taken along the axis III—III indicated for the sake of clarity in FIG. 2, illustrating the means for locking the plate to the supporting frame.
Figure 5:
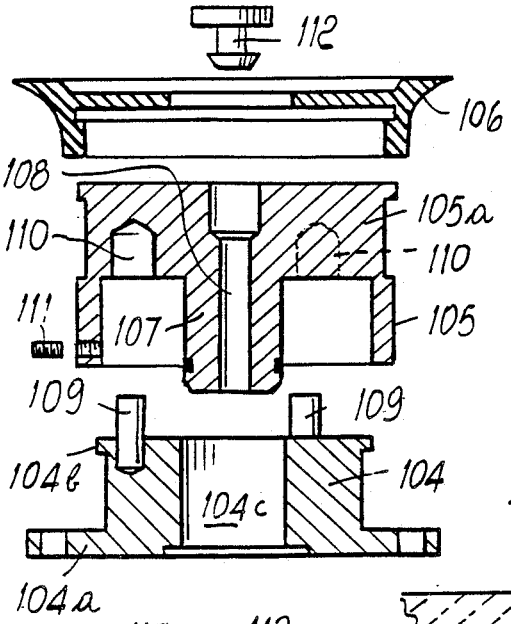
FIG. 5 is an exploded sectional view of an assembly with two half-bodies for retaining the glass-plate.
Figure 6:
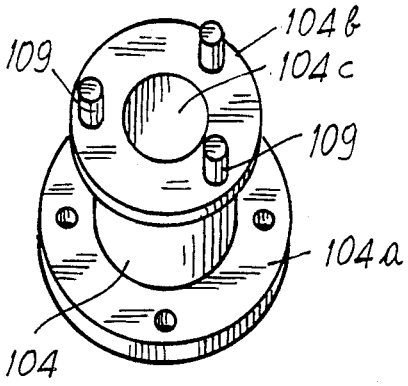
FIG. 6 is a perspective view of the lower half-body illustrated in FIG. 5.
Figure 7:
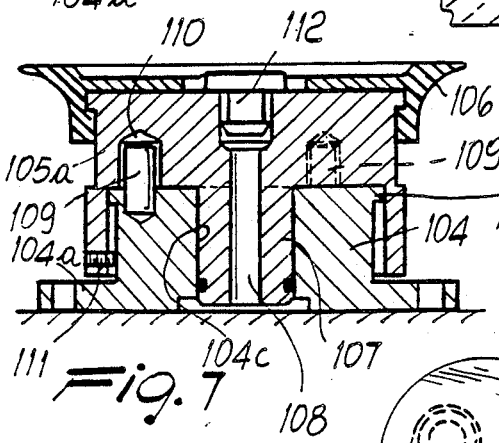
FIGS. 7 and 8 are instead sectional views of the assembly of FIG. 1 respectively in lowered and raised position with respect to the plane of the arm of the supporting head.
Figure 8:
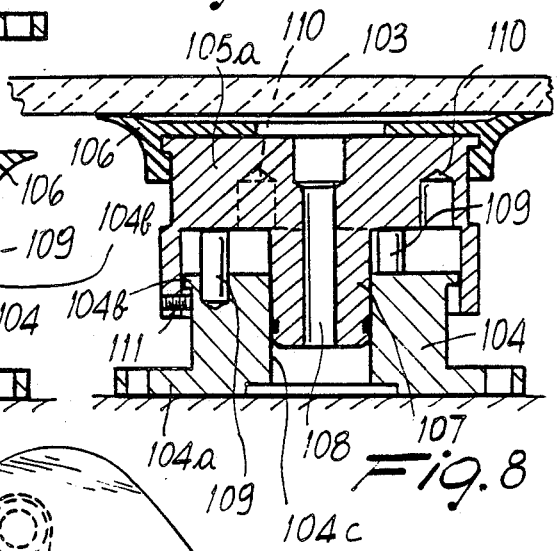
Figure 4:
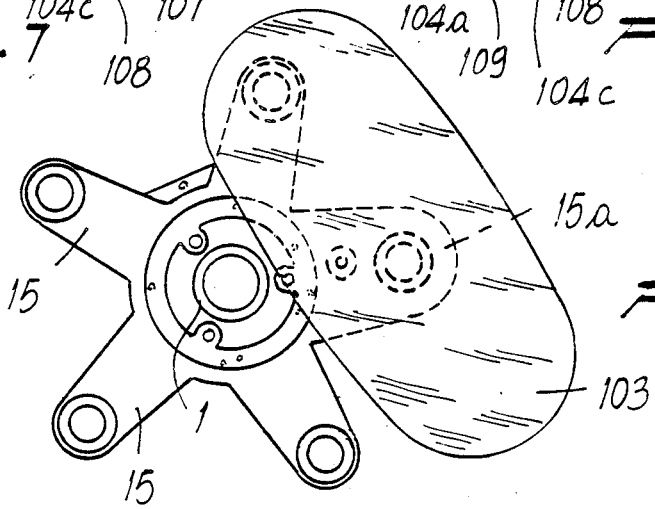
FIG. 4 is a schematic plan view of a cross-like supporting head, with a related auxiliary head on which a small-size glass or marble plate is retained by means of a sucker so as to allow its machining along its peripheral edges.

With reference to FIGS. 1 to 3, the supporting head particularly for machining plates of glass, marble or the like of any size, generally indicated by the reference numeral 1, comprises a supporting frame 2 for a main head, generally indicated by the reference numeral 3, having a main shaft 4 rotating about its own axis. The supporting frame 2, of which only a portion has been illustrated schematically, rotatably supports the main head 3 which is covered in a known manner by a casing 13.

The supporting head furthermore has an auxiliary head, generally indicated by the reference numeral 5, which in turn has an auxiliary shaft 6 which is conveniently entrained in rotation about its own axis by means of a first gear 7 keyed on the main shaft 4 and meshing with a transmission gear 8 which in turn meshes with a second gear 9 keyed on the auxiliary shaft 6.

The presence of the transmission gear 8 allows to maintain the direction of rotation of the auxiliary head identical to the direction of rotation of the main head during normal machining steps.

A support plate 10 is rotatably associated with the main shaft 4 and supports the auxiliary shaft 6 and comprises locking means, generally indicated by the reference numerals 11 and 12, adapted to selectively rigidly associate, according to the requirements, the plate 10 with the supporting frame 2, so as to lock the same to the frame 2 and allow the rotation of the main shaft 4 and therefore of the first gear 7 in order to transmit the rotary motion to the auxiliary shaft 6 by means of the second gear 9 and the transmission gear 8.

In the opposite instance locking means are adapted to rigidly couple the plate 10 to the first gear 7, making them both rigidly coupled in rotation about the axis defined by the main shaft 4, and therefore to not allow a rotation of the auxiliary shaft 6 about its own axis but allow the rotation of said shaft about the main shaft 4 together with the plate 10.

The plate 10 has a plurality of arms, each indicated by the reference numeral 15, extending radially from its axis of rotation and having, proximate to their ends, assemblies 16 for means for retaining a glass plate and more precisely suckers arranged along a circumference having its center on the axis of the main shaft 4.

At least one of said arms 15, and more precisely the arm 15*a*, supports the auxiliary head 5, which has a sucker 17 which is also conveniently arranged on the circumference of arrangement of said other suckers.

Merely for the sake of greater precision, it should furthermore be noted that said locking means comprise at least one screw 20 which engages with one of its portions in the plate 10 and with its remaining end portion in the gear 7, and that its screwing or unscrewing is against or due to the action of elastic means, e.g. a spring 21.

When the screw 20 rigidly couples the plate 10 to the first gear 7, the plate and the first gear are caused to rotate about the axis defined by the main shaft 4.

In the illustrated case there are three screws 20 engaged in holes 22 defined in the plate 10 and angularly offset with respect to one another.

The locking means furthermore comprise a dowel 23 insertable in a suitable hole 24 of the plate 10 and adapted to rigidly couple the plate 10 to the supporting frame 2 so that after the disengagement of the screw 20 between the plate and the first gear 7 said gear 7 can rotate freely together with the main shaft 4 and cause the rotation of the auxiliary shaft 6.

With the described arrangement it is thus possible to use for example a small-size sucker and consequently perform machining on plates with very reduced dimensions without modifying any part of the head according to the invention.

The operation of the supporting head according to the invention is evident from what has been described and illustrated, and in particular it can be observed that if it is necessary to machine a large-size glass plate it is sufficient to screw the screw 20 so that it rigidly couples the plate 10, which supports the glass plate, to the first gear 7 and remove the dowel 23.

In this manner the rotation of the main shaft 4 causes the rotation of the entire plate without the auxiliary shaft 6 being caused to rotate about its own axis and therefore allows the required machining of the glass plate by means of an appropriate apparatus.

If it is necessary to machine on the same head a glass or marble plate of extremely small size, e.g. a few centimeters, it is sufficient to unscrew the screw 20 and thus disengage the plate 10 from the first gear 7 and at the same time lock the plate 10, by means of the dowel 23, to the supporting frame 2.

In this manner, while the plate 10 remains fixed, the first gear 7 can rotate freely together with the main shaft 4 and, as already described, by means of the second gear 9 and the transmission gear 8 interposed therebetween, cause the rotation of the auxiliary shaft 6 and therefore of the glass plate resting on the auxiliary head 5.

To prevent the plate applied to the auxiliary head 5 from colliding, during its rotation, with the retention assemblies 16 of the flanking arms 15 it is possible to advantageously use a retention assembly formed by two half-bodies which is illustrated in FIGS. 4 to 8.

The paired half-body assemblies, which are applied to the arms which do not bear the auxiliary head 5, may be lowered when only the auxiliary head is caused to rotate and thus move the respective suckers to a lower lever than that of the sucker of the auxiliary head in operation.

According to the invention, and as illustrated in FIGS. 5 to 8, each of the sucker-holder bodies of the arms which must remain motionless during rotation of the auxiliary head is constituted by a hollow cylindrical body 104 having a base flange 104*a* for coupling to the arm and, upwardly, a peripheral edge 104*b* adapted to constitute a stop means the function whereof will become apparent hereinafter. A cup-like body 105 is telescopingly associable with the body 104 and is substantially in the shape of an inverted cup with its bottom 105*a* shaped so as to stably accommodate an ordinary sucker 106. Centrally to the cup-like body 105 there is a cylindrical guiding body 107 adapted to slide sealingly, by means of ordinary elastic rings, within the cylindrical cavity 104*c* of the hollow body 104 (FIG. 7); the body 107 is then axially traversed by a cylindrical cavity 108 adapted to allow the creation of vacuum (in a known manner) inside the sucker 106.

To allow the stable location of the cup-like sucker-holder body 105 at such a height as to keep its own sucker at the level of the sucker of the auxiliary head (in the case of machining of large-size plates), there are spacing means constituted by pins 109 rigidly associated at one end with the fixed body 104 and protruding so as to be accommodated within corresponding cavities 110 provided in the bottom 105*a* of the cup-like body 105.

To prevent the slipping of the cup-like body 105 out of the hollow body 104 during the spacing of the two bodies there is a dowel or screw 111 inserted transversely to the free end of the cup-like body and protruding inside the latter enough to collide, when the bodies are spaced with the peripheral edge 104*b* of the hollow body 104, thus stopping the divarication excursion of the cup-like body.

Each sucker-holder body constituted by two mutually telescopically spaceable half-bodies therefore allows to keep the sucker of the arms 15 at a lower level than that of the sucker of the auxiliary head 105 (FIG. 4), since in this position the pins 109 are inserted in the corresponding holes 110; in this position the suckers of the arms cannot thus interfere with the plate 103 rotating on the auxiliary head.

Instead, in the case of machining of large-size plates 103, wherein all the suckers must intervene and be therefore located co-planar to one another and to the sucker of the auxiliary head, the cup-like half-body is extracted from the hollow half-body 104 until the dowels 109 exit from their respective seats or holes 110, then a partial rotation of the cup-like body is performed so as to locate the individual holes 110 out of axis to their respective pins. In this position the bottom of the cup rests on the end of the dowels, keeping the cup-like body stably raised with its own sucker at the preset level (FIG. 5), i.e. at the level of the sucker of the auxiliary head. By means of a rotation of the cup-like body of equal angular amplitude in the opposite direction (or even in the same direction in the case of three dowels arranged at 120° to one another) the pins are returned to the holes, thus allowing the cup-like body to descend and move its own sucker to a lower level for a successive machining of small-size plates. Finally, during the machining of small-size plates the cavity 108 of each cup-like body is obviously plugged with an ordinary plug 112.

In practice it has been observed that the supporting head according to the invention is particularly advantageous in that it has extreme flexibility in use since large-size, small-size and extremely small-size plates can be indifferently machined thereon as required without any structural modification.

The invention thus conceived is susceptible to numerous modifications and variations, all of which are within the scope of the inventive concept; furthermore all the details may be replaced with other technically equivalent elements.

In practice, the materials employed, as well as the dimensions, may be any according to the requirements and to the state of the art.

I claim:

1. Supporting head, particularly for machining panes of glass, marble and the like, comprising a frame supporting a main-head and a main shaft, said main head comprising a plate, said plate supporting an auxiliary head, said main shaft being a driving shaft and having a first gear, said auxiliary head having an auxiliary shaft connected to said plate, said auxiliary shaft having a second gear, said main shaft and auxiliary shaft being parallel, said first gear engaging a transmission gear, said transmission gear engaging said second gear, said plate having a plurality of arms extending radially and perpendicularly to said main shaft, said plate being rotatable with a center of rotation at said main shaft, one of said arms bearing said auxiliary head, said arms having securing members adapted to secure a pane on said plate, said auxiliary head having a securing member adapted to secure a pane, said plate having locking means for selectively locking said plate to said first gear for a rotation of said plate at said center of rotation and for locking said plate to said frame for a rotation of said auxiliary head at said auxiliary shaft, said pane being selectively secured to said securing members of said plate, when said plate rotates at said center of rotation, or to said securing member of said auxiliary head, when said plate is locked to said frame and said auxiliary head rotates at said auxiliary shaft.

2. Supporting head particularly for machining panes of glass, marble and the like, comprising a frame supporting a main head and a main shaft, said main head comprising a plate, said plate supporting an auxiliary head, said main shaft having a first gear, said auxiliary head having an auxiliary shaft connected to said plate, said auxiliary shaft having a second gear, said first gear operating said second gear for rotation of said auxiliary head, said first gear being adapted to rotate said plate, said plate having locking means for selectively locking said plate to said first gear for a rotation of said plate and for locking said plate to said frame for a rotation of said auxiliary head, said plate having members for securing a pane to said head, said securing members comprising at least one sucker and being arranged along a circumference having its center at said main shaft, said auxiliary head being on said circumference and having at least one sucker for securing a pane, said securing members on said plate comprising an assembly formed by two half bodies, a first one of said half bodies bearing said sucker, a second one of said half bodies being fixed, said first half body being telescopically moveable on said second half body from a first position, at a lower level than said auxiliary head, to a second position at the same level of said auxiliary head, said first half body bearing said sucker, at said second position said sucker of said first half body being at the same level of said sucker of said auxiliary head, said plate being held by said sucker of said half bodies and by said sucker of said auxiliary head, at said first position said plate being held by just said sucker of said auxiliary had, each of said assemblies having coupling means between said first and second half bodies, said coupling means allowing for a partial rotation of said second half body in either directions for respectively lowering said second half body to partially insert into said first half body and raising said second body to the same level of said auxiliary head.

3. Supporting head, according to claim 2, wherein said first half body comprises a cylindrical hollow body fixed to said plate, said hollow body having protruding pins, said second half body comprising an inverted cup body slideably mounted on said hollow body and having holes, said protruding pins being adapted to insert in said holes, said inverted cup body having a cylindrical coaxial inner element adapted to slide and engage in said hollow body.

4. Supporting head, according to claim 3, wherein said hollow body comprises an upper radially protruding edge, said inverted cup body having a transverse dowel, said dowel abutting with said protruding edge to constitute a stop means preventing the complete disengagement of said inverted cup body from said hollow body.

* * * * *